United States Patent [19]

Courtis

[11] Patent Number: 4,470,221

[45] Date of Patent: Sep. 11, 1984

[54] GATE ASSEMBLY

[75] Inventor: Thomas M. Courtis, Luther, Mont.

[73] Assignee: Red Lodge Manufacturing Company, Red Lodge, Mont.

[21] Appl. No.: 483,579

[22] Filed: Apr. 11, 1983

Related U.S. Application Data

[63] Continuation-in-part of Ser. No. 237,713, Feb. 24, 1981, Pat. No. 4,381,626, which is a continuation-in-part of Ser. No. 82,543, Oct. 9, 1979, Pat. No. 4,270,312.

[51] Int. Cl.[3] ..... E05D 7/00

[52] U.S. Cl. ..... 49/485; 49/331; 49/386

[58] Field of Search ..... 49/385, 331, 386

[56] References Cited

U.S. PATENT DOCUMENTS

| | | | |
|---|---|---|---|
| 1,062,928 | 5/1913 | Roof | 49/385 |
| 1,386,113 | 8/1921 | Houck | 49/327 |
| 3,839,826 | 10/1974 | Reis | 49/385 X |
| 4,270,312 | 6/1981 | Courtis et al. | 49/385 |
| 4,381,626 | 5/1983 | Courtis et al. | 49/385 |

*Primary Examiner*—Kenneth Downey
*Attorney, Agent, or Firm*—Arthur L. Urban

[57] ABSTRACT

A gate assembly including a support portion and a gate portion carried by the support portion and movable with respect thereto, a gate control portion and a gate activating portion associated with the gate portion; the gate portion having one end thereof disposed adjacent to the support portion and extending outwardly therefrom, pivot mechanism connecting a lower part of the gate portion to an adjacent lower part of the support portion; the gate control portion including biasing mechanism associated with the gate portion; the gate activating portion including a power source mounted within the frame members of the support portion adjacent one end thereof, drive mechanism including translatable mechanism activatable by the power source, the translatable mechanism including a pair of transversely spaced roller assemblies slidably carried on spaced horizontal rail members, the drive mechanism also including continuous flexible loop mechanism supported adjacent the ends of each rail member, each roller assembly being secured to one of the loops, a pair of arm members extending from the roller assemblies to the gate portion with one arm member being disposed on each side of the gate portion, each arm member having one end pivotally connected to the respective roller assembly disposed on the same side of the gate portion and the opposite end of the arm member being pivotally connected to the gate portion adjacent the lower edge thereof and spaced from the pivotal connection of the gate portion with the support portion.

11 Claims, 3 Drawing Figures

GATE ASSEMBLY

This application is a continuation-in-part of pending application Ser. No. 237,713, filed Feb. 24, 1981, now U.S. Pat. No. 4,381,626 which in turn is a continuation-in-part of copending application Ser. No. 82,543, filed Oct. 9, 1979, now U.S. Pat. No. 4,270,312.

This invention relates to a novel gate assembly and more particularly relates to a new gate assembly which can be operated automatically.

For many centuries, individuals have enclosed their land to protect their home and other property. This has been done both in urban and rural areas. In some cases, the enclosures have been simple fences to keep children or animals confined, while in other situations the fencing serves to protect the property against human or animal intruders.

Regardless of the type of enclosure or fencing utilized, some type of opening must be provided for ingress and egress to and from the property. Generally, the opening has a gate. Gates commonly are used for walkways and roadways. The most common gate style is the swinging gate. While swinging gates are satisfactory for walkways, their use becomes more cumbersome as they increase in size, such as for roadways.

Conventional roadway gates have a number of drawbacks. For example, the weight of roadway gates presents a problem in the selection of the hinges. Also, the weight may make the gate difficult to operate. In an attempt to solve these problems, pairs of gates meeting at the center sometimes are utilized.

Another problem with roadway gates is the necessity for getting out of the vehicle to open the gate, driving the vehicle through and getting out of the vehicle again to close the gate. This is troublesome even under ideal weather conditions, but in inclement weather and at night it is especially unpleasant.

It has been proposed to utilize power operated roadway gates. However, mechanisms to operate swinging gates are complicated and expensive. As a result, other proposals for power operated roadway gates have been made. Some gates have an overhead framework into which the gates are raised. Such gates of necessity have limited overhead clearance and are unsightly in appearance because of the overhead structural elements.

One power operated gate of a different design pivots the gate so that it stands on end when opened. This type of gate is the subject of U.S. Pat. No. 3,839,826. The gate utilizes a combination of a tension spring and a torsion spring. The tension spring urges the gate from the closed position toward the open position while the torsion spring acts in the opposite direction.

Although this vertically swinging gate construction offers advantages over swinging gates, particularly in snowy climates, it has certain shortcomings. The motor has to be of considerable size because of its location adjacent the pivot point of the gate. Also, the use of the combination of the torsion spring and the tension spring makes the design somewhat complicated and increases the cost thereof.

The present invention provides a novel gate assembly that can be operated simply and conveniently with a conventional power source. The gate assembly can be powered by a common garage door opening unit. The gate assembly can be operated manually if desired using only a minimum of effort. Thus, the gate assembly of the invention can be opened easily in the event of a power stoppage.

The gate assembly of the present invention is simple in design and relatively inexpensive to manufacture. The gate assembly can be fabricated from commercially available components and materials. The design of the gate assembly minimizes the possibility of vandalism, particularly to the operating mechanism. Further, the design provides a maximum opening for a given overall length. The gate assembly of the invention provides an aesthetically pleasing low silhouette.

The gate assembly can be installed by a homeowner or ranch hand with a minimum of instruction. The gate assembly of the invention can be adapted to provide a positive lock if desired. In addition, the gate assembly of the invention provides for adjustment of the operating mechanism as components thereof age and/or wear.

These and other benefits and advantages of the novel gate assembly of the present invention will be apparent from the following description and the accompanying drawings in which.

Figure 1:
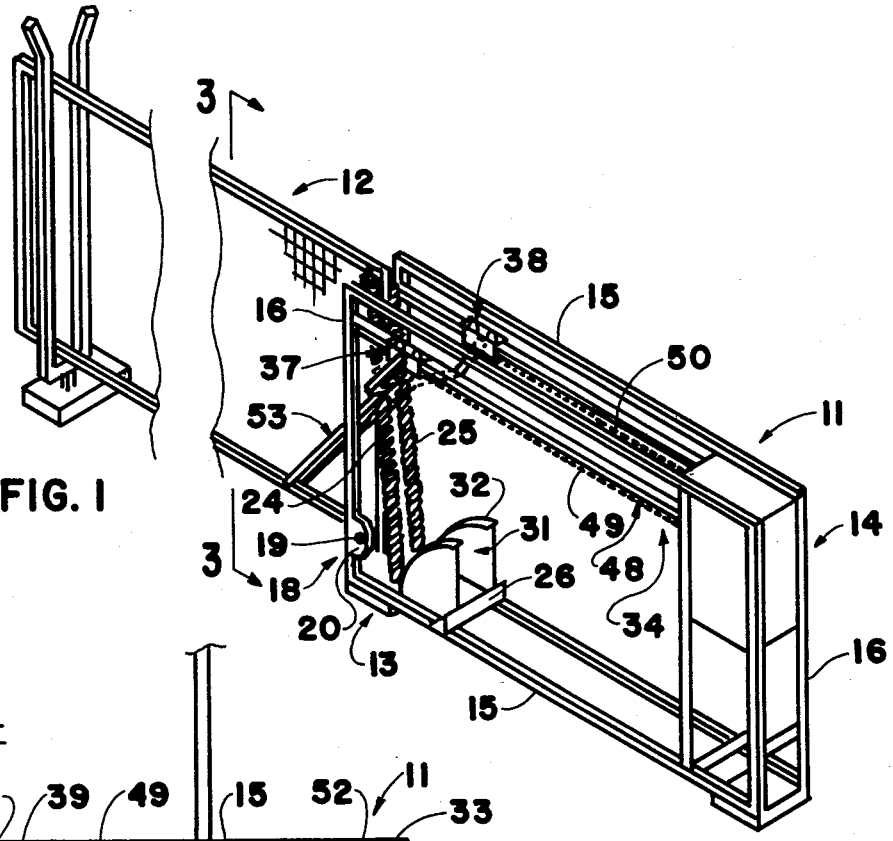
FIG. 1 is a view in perspective of one form of the gate assembly of the invention in a closed position.

As shown in the drawings, one form of the novel gate assembly of the invention includes a support portion 11 and a gate portion 12 carried by the support portion. The gate portion 12 is movable with respect to the support portion 11. Also, a gate control portion 13 and a gate activating portion 14 are included in the gate assembly. The gate control portion 13 and the gate activating portion 14 preferably are mounted on frame members 15 and generally vertical members 16. Advantageously, the support 11 includes pairs of generally horizontal and vertical frame members 15 and 16 disposed on either side of the gate.

Gate 12 which is movable with respect to the support 11 has one end thereof disposed adjacent thereto with the gate 12 extending outwardly therefrom. The lower part of the gate end adjacent to the support frame is connected thereto through pivot means 18.

The pivot means 18 connecting the gate 12 with the support frame 11 includes a rotatable shaft 19 and shaft support means. Shaft 19 is carried by shaft supporting brackets 20 affixed to vertical frame members 16. Pivot means 18 advantageously may include a gate support member 22 that can be affixed or carried by the central portion of shaft 19. Preferably, the gate support member 22 includes a gate engaging channel section which is secured to the end of the gate 12 adjacent support frame 11. In this case, the shaft 19 may be located on the side of frame member 16 adjacent to the spring members.

The gate control portion 13 includes biasing means and advantageously at least one coil spring member 24. Preferably, the biasing means includes a pair of coil spring members 24 and 25. The spring members 24 and 25 are spaced from each other a sufficient distance that the gate 12 may pass therebetween in its movement from a closed to an open position.

The upper end of each spring member is attached adjacent the upper corner of the gate closest thereto, that is, closest to the vertical frame members 16. The opposite or lower end of each spring member is affixed to a cross member 26 extending between lower horizontal frame members 15 of support 11 at a point therealong spaced from the pivot means 18. Advantageously, the lower ends of the spring members are spaced a distance from the shaft 19 of the pivot means 18 between about 25% and 40% of the length of the spring members.

Figure 2:
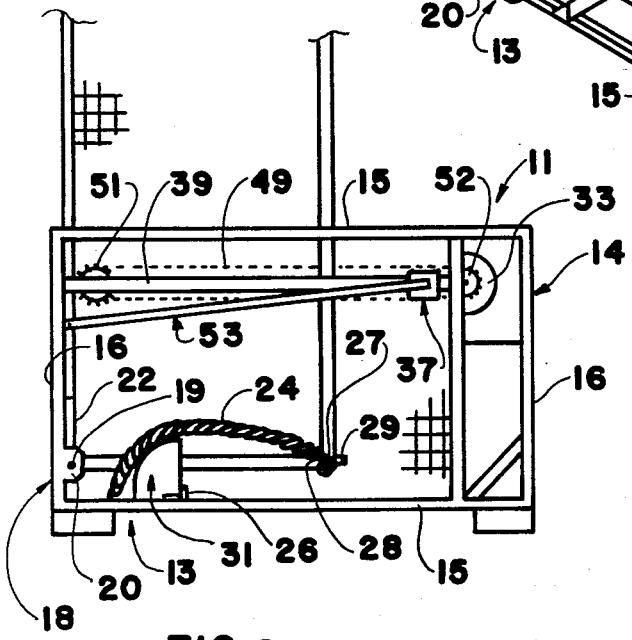
FIG. 2 is an enlarged fragmentary side view of the gate assembly shown in FIG. 1 in an open position.
Figure 3:
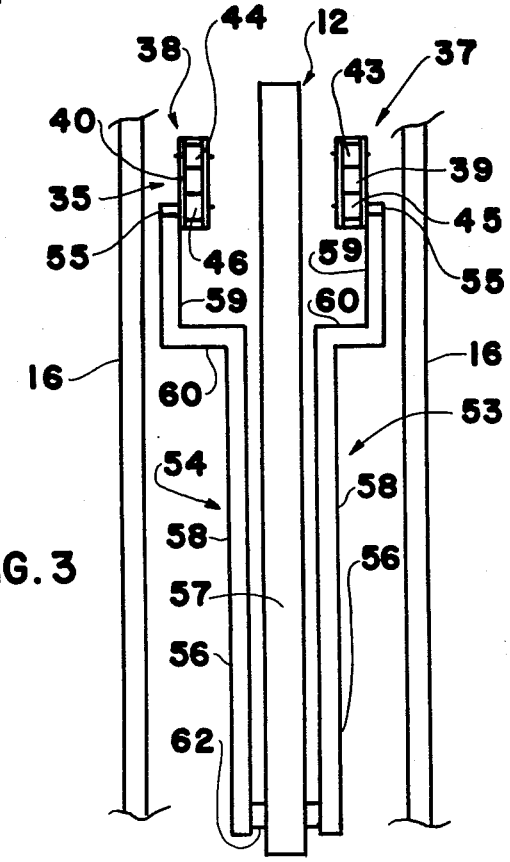
FIG. 3 is a sectional view of the gate assembly shown in FIG. 1 taken along line 3—3 thereof.

The gate assembly advantageously also includes spring adjusting means. Preferably, the spring adjusting means changes the length and thereby the tension in the spring members 24 and 25. The upper ends of the spring members 24 and 25 advantageously are connected to the adjacent upper corner of the gate 12 through the spring adjusting means, which preferably may include a fixed portion 27 and a movable portion 28. As shown in FIG. 2, section 27 is affixed adjacent the corner of the gate 12 and movable section 28 engages the upper ends of the spring members 24 and 25. A screw 29 is operatively connected to the movable spring holding section 28 to provide adjustment thereof.

Fulcrum means 31, advantageously also a part of the gate control portion 13, is disposed adjacent the lower end of the spring members 24 and 25. The fulcrum means 31 is affixed between the lower horizontal frame members 15 on the side of the spring members remote from the pivot means 18. The fulcrum 31 includes an arcuate spring-engaging section 32 disposed in substantially the same vertical plane as the coil spring members. Advantageously, the spring-engaging section 32 of the fulcrum describes an arc of between about 120° and 180°.

The spring-engaging section 32 preferably is spaced from the lower ends of the spring members a distance between about 10% and 30% of the length of the spring members. The fulcrum 31 may serve for both of the spring members 24 and 25 or more advantageously as shown, a separate fulcrum may be utilized adjacent each spring member. With this arrangement, the spacing of the fulcrums provides clearance for the passage of the gate 12 therebetween.

The gate assembly of the invention includes a gate activating portion 14 to provide movement of the gate 12 from the down or closed position to the open or raised position and return. The gate activating portion 14 advantageously is mounted on the support portion 11 and preferably within the framework thereof. Gate activating portion 14 includes a power source which advantageously includes an electric motor 33 and also includes drive means 34 operatively connected to the power source.

Drive means 34 includes translatable means 35. The translatable means 35 is activatable by the power source 33. The translatable means 35 is disposed for movement in a substantially horizontal plane. The translatable means 35 includes a pair of roller assemblies 37 and 38. The roller assemblies 37 and 38 are transversely spaced from one another. Each roller assembly 37 or 38 is slidably carried on a horizontal rail member 39 or 40.

The rail members 39 and 40 extend from adjacent the power source 33 toward the opposite end 42 of the support portion 11. The rail members are disposed adjacent the upper part of the support portion. The rail members are disposed substantially parallel to the side edges of the support portion 11 and spaced from each other. The spacing between the rail members 39 and 40 is sufficient to accommodate the gate portion 12 therebetween.

Each of the roller assemblies 37 and 38 includes a plurality of rollers 43, 44, 45 and 46. The rollers 43–46 are in contact with the rail members 39 and 40. Advantageously, rollers 43 and 44 are disposed above the respective rail member and rollers 45 and 46 are disposed below the rail member.

The drive means 34 also includes continuous flexible loop means 48. The continuous loop means 48 are supported adjacent the ends of each rail member. The loop means 48 preferably include endless chains 49 and 50 supported on sprockets 51 and 52. A roller assembly 37 or 38 is secured to each of the loop means 48.

Arm members 53 and 54 extend from the roller assemblies 37 and 38 to the gate portion 12. One arm member 53 or 54 is disposed on each side of the gate portion 12. Each arm member has one end 55 pivotally connected to the respective roller assembly 37 or 38 that is disposed on the same side of the gate portion 12.

The opposite end 56 of each arm member is pivotally connected to the gate 12. The pivotal connection to the gate is adjacent the lower edge 57 of the gate. The connection is spaced from the pivotal means 18 of the gate 12 with the support 11. The arm members 53 and 54 are disposed in substantially the same plane. The pivotal connections of the lower ends 56 of the arm members to the gate 12 advantageously are achieved through a common pin 62 extending through the arm ends and the gate.

Each of the arm members 37 and 38 preferably includes a main longitudinal section 58 that extends closely adjacent along the gate portion 12. In addition, the arm members each advantageously include a secondary longitudinal section 59 adjacent the respective roller assembly 37 or 38. The secondary longitudinal section 59 is offset from the main longitudinal section 58 and connected therewith. In a preferred embodiment, the main and secondary longitudinal sections 58 and 59 are connected by a short transverse section 60.

In the operation and use of the gate assembly of the present invention as shown in the drawings, the gate activating portion 14 may be actuated such as with a radio transmitter and receiver (not shown) of a garage door operator. This starts the operation of the electric motor 33 and the rotation of sprockets 51 and 52. The rotation of sprockets 51 and 52 moves chains 49 and 50 carried thereby. The movement of the chains advances roller assemblies 37 and 38 attached thereto.

Moving roller assemblies 37 and 38 causes arm members 53 and 54 pivotally connected thereto to be drawn into the support portion 11. Since the arm members 53 and 54 are pivotally connected at their lower ends to the lower edge 57 of the gate, the end of the gate is rotated about pivot means 18 including shaft 19.

As the gate moves into the support frame 11, the ends of the spring members 24 and 25 affixed to the upper corner of the gate will move past the fulcrums 31 causing the spring members to wrap around the spring-engaging sections 32 of the fulcrums. The upward movement of the gate 12 continues until the gate has rotated to a vertical position at approximately a right angle to its original horizontal position.

To close the gate assembly, the radio transmitter may be actuated again to reverse the motor 33 and the direction of travel of the chains 49 and 50, the roller assemblies 37 and 38 and the arm members 53 and 54. This action moves the adjacent end of the gate 12 from a position close to the lower horizontal frame members 15 past the fulcrums 31 again to its original position adjacent the vertical frame members 16. Simultaneously, with the travel of the gate 12, the upper parts of the spring members attached at the upper corner of the gate move away from the spring-engaging fulcrum sections 32 and return from the bent configuration (when the gate is open) to the straight configuration again.

Operation of the gate assembly of the invention also can be effected through the use of electrical switches (not shown) located adjacent the assembly rather than with a radio transmitter. In addition, if there should be a power failure, the gate assembly can be operated manually. Manual operation may be achieved conveniently by releasing a clutch (not shown) on motor 33 or by disconnecting arm members 53 and 54 from the gate and/or from roller assemblies 37 and 38 and simply lifting the free end of the gate 12.

Since the spring members 24 and 25 in combination with the fulcrums 31 provide an effective counterbalancing of the movement of the gate, the gate can be lifted manually with a minimum of effort. Also, since the spring members 24 and 25 function effectively over the entire path of movement of the gate from an open to a closed position and vice-versa, positive control of the gate movement is achieved during the entire operation.

The above description and accompanying drawings show that the present invention provides a novel gate assembly that can be operated with a power source such as a conventional garage door opening unit. The gate assembly can be operated manually in the event of a power failure with a minimum of effort. The gate assembly can be operated through a radio transmitter or suitable switches.

The gate assembly of the present invention is simple in design yet minimizes the possibility of vandalism. In addition, the design provides a low silhouette appearance with a maximum opening for a given overall length.

The gate assembly of the invention can be fabricated from commercially available components and materials relatively inexpensively. The gate assembly of the invention can utilize commercially available gates or custom fabricated gates.

The gate assembly of the present invention can be installed by a homeowner or a ranch hand with a minimum of instruction. In addition, the gate assembly provides for the adjustment of the control mechanism as components thereof age and/or wear.

It will be apparent that various modifications can be made in the particular gate assembly described in detail above and shown in the drawings within the scope of the invention. For example, the size, configuration and arrangement of the components can be changed to meet specific requirements. Also, a variety of structural materials may be utilized in the fabrication of the gate assembly as desired. Therefore, the scope of the invention is to be limited only by the following claims.

What is claimed is:

1. A gate assembly including a support portion and a gate portion carried by said support portion and movable with respect thereto, a gate control portion and a gate activating portion associated with said gate portion; said support portion including a plurality of frame members; said gate portion having one end thereof disposed adjacent to said support portion and extending outwardly therefrom, pivot means connecting a lower part of said gate portion to an adjacent lower part of said support portion, said pivot means including a rotatable shaft and shaft support means; said gate control portion including biasing means associated with said gate portion; said gate activating portion including a power source mounted within said frame members of said support portion adjacent one end thereof, drive means operatively connected to said power source, said drive means including translatable means activatable by said power source, said translatable means being disposed for movement in a substantially horizontal plane, said translatable means including a pair of transversely spaced roller assemblies slidably carried on spaced horizontal rail members, said rail members extending from adjacent said power source toward the opposite end of said support portion, said rail members being disposed adjacent the top of said support portion and substantially parallel to the side edges thereof, the spacing between said rail members being sufficient to accommodate said gate portion therebetween, each of said roller assemblies including a plurality of rollers in contact with said rail members, said drive means also including continuous flexible loop means supported adjacent the ends of each rail member, each roller assembly being secured to one of said loop means, a pair of arm members extending from said roller assemblies to said gate portion with one arm member being disposed on each side of said gate portion, each arm member having one end pivotally connected to the respective roller assembly disposed on the same side of said gate portion and the opposite end of said arm member being pivotally connected to said gate portion adjacent the lower edge thereof and spaced from the pivotal connection of said gate portion with said support portion, said arm members being disposed in substantially the same plane; whereby said gate portion is movable about said pivot means in a vertical plane by said gate activating portion.

2. A gate assembly according to claim 1 wherein said support portion has a horizontal dimension only slightly larger than the vertical dimension of said gate portion.

3. A gate assembly according to claim 1 wherein each of said arm members includes a main longitudinal section extending closely adjacent along said gate portion.

4. A gate assembly according to claim 3 wherein said arm member includes a secondary longitudinal section adjacent said roller assembly that is offset from said main longitudinal section and connected therewith.

5. A gate assembly according to claim 4 wherein said main and secondary longitudinal sections are connected by a short transverse section.

6. A gate assembly according to claim 1 wherein said roller assemblies include rollers disposed above and below said rail members.

7. A gate assembly according to claim 1 wherein said flexible loop means includes a chain.

8. A gate assembly according to claim 1 wherein said power source includes an electric motor.

9. A gate assembly according to claim 1 wherein said biasing means includes at least one coil spring member extending between an upper part of said gate portion adjacent to said support portion and said support portion at a point spaced from said pivot means.

10. A gate assembly according to claim 9 including fulcrum means disposed adjacent the end of said spring member affixed to said support portion.

11. A gate assembly according to claim 10 wherein said biasing means includes a pair of spring members and a pair of fulcrum means.

* * * * *